US006402548B1

(12) United States Patent
Ruiz et al.

(10) Patent No.: US 6,402,548 B1
(45) Date of Patent: Jun. 11, 2002

(54) METHOD AND DEVICE FOR INTERCONNECTING CONNECTING TERMINALS

(75) Inventors: Ariel Ruiz, Lyons; Arsene Schmidt, D'or, both of (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/544,331

(22) Filed: Apr. 6, 2000

(30) Foreign Application Priority Data

Apr. 12, 1999 (FR) ..... 99 04683

(51) Int. Cl.[7] ..... H01R 31/08
(52) U.S. Cl. ..... 439/507; 439/395
(58) Field of Search ..... 439/395, 417, 439/521, 590, 540.1, 507, 509, 512, 849, 850, 856, 857, 861

(56) References Cited

U.S. PATENT DOCUMENTS

| | | | | | |
|---|---|---|---|---|---|
| 3,503,036 A | * | 3/1970 | Desso et al. | ..... | 439/857 |
| 4,456,317 A | | 6/1984 | McCleerey | ..... | 339/14 |
| 4,659,158 A | * | 4/1987 | Sakamoto et al. | ..... | 339/19 |
| 4,944,692 A | * | 7/1990 | Allina | ..... | 439/517 |
| 5,201,667 A | | 4/1993 | Endo et al. | ..... | 439/189 |
| 5,462,459 A | * | 10/1995 | Childs | ..... | 439/843 |
| 5,609,493 A | * | 3/1997 | Cheng et al. | ..... | 439/157 |
| 5,683,267 A | * | 11/1997 | Ribbeck et al. | ..... | 439/395 |

FOREIGN PATENT DOCUMENTS

| | | | | |
|---|---|---|---|---|
| EP | 0 188 034 A | 7/1986 | ..... | 339/19 |
| EP | 0 247 360 A | 12/1987 | ..... | 439/407 |
| EP | 0 601 538 A | 6/1994 | ..... | 439/189 |

* cited by examiner

*Primary Examiner*—Gary Paumen
*Assistant Examiner*—Ann McCamey
(74) *Attorney, Agent, or Firm*—Oliff & Berridge, PLC

(57) ABSTRACT

A device comprising a connecting strip from which contact pins extend. The connecting strip extends in a plane perpendicular to the direction in which the pins extend, and a connecting pin extends from each of the two opposed longitudinal edges of the connecting strip in the region of each connecting terminal. Two connecting pins facing each other form a clip which allows interconnection by gripping the edges of an insulation-displacement and retaining slit.

36 Claims, 2 Drawing Sheets

METHOD AND DEVICE FOR INTERCONNECTING CONNECTING TERMINALS

BACKGROUND OF THE INVENTION

The present invention relates to a method and to a device for interconnecting connecting terminals, particularly insulation-displacement connecting terminals.

In the field of electrical connection apparatus, it is known practice for electrical components, for example junction blocks, aligned one beside the other, to be placed next to each other. It is thus common for a series of identical junction blocks to be aligned along one and the same rail.

It is also known practice for electrical members, such as junction blocks, aligned one beside the other, to be interconnected. These electrical members generally comprise a host structure which possibly consists of a female component designed specifically to take a type of clip. This structure may simply amount to an opening made in a connecting element, for example of the conducting strip type, to allow insertion and establish electrical contact between this connecting element and a clip.

DESCRIPTION OF THE PRIOR ART

To make a connection between several electrical components, for example adjacent junction blocks, it is known practice to employ interconnection strips. Strips of this type are made with the number of clips required by the user. Documents DE-44 11 306 or FR 2 764 445 disclose such interconnection strips. The use of these strips assumes that the electrical components to be interconnected have a structure intended to take a clip.

However, junction blocks exist which are designed without a structure to allow interconnection with adjacent junction blocks. Such junction blocks are, for example, blocks designed with miniaturization in mind. The area of interest here is, more specifically, junction blocks which have an insulation-displacement connecting terminal comprising an insulation-displacement and retaining slit.

The object of the present invention is to provide a new method and a new device for the interconnection of such connecting terminals. This device may advantageously be used with junction blocks which are equipped with connecting terminals such as those described and claimed in document EP-0 247 360. A connecting terminal of this kind comprises a conductive connecting piece with a straight insulation-displacement and retaining slit for the cores of the wires, which is immobilized in a housing of an insulating casing itself provided with an opening which extends opposite the insulation-displacement and retaining slit to allow the wires to be inserted transversely over the insulation-displacement mouth that this slit comprises and to allow the insulating sheaths of the wires, the core of which is retained in said slit, to be immobilized. Still according to this document, the slit is formed longitudinally along a profiled part of the conductive piece which, in this region, has a hollow polygonal cross section allowing the translational guidance along the slit of an end part of an external tool designed to slide on each side and between the folds delimiting the edges of the slit, so as to push the wires into this slit in a transverse position with respect to it, being guided in the internal cavity of the profiled part, said tool end being guided in translation from outside the insulating casing toward said cavity by the edges of a hole formed in said insulating casing for this purpose.

SUMMARY OF THE INVENTION

The method according to the invention is a method for interconnecting connecting terminals exhibiting an insulation-displacement and retaining slit, using an interconnection comb comprising a connecting strip from which contact pins extend. According to the invention, the free end of the contact pins forms a clip, and the interconnection of two connecting terminals is achieved by making the ends of two contact pins grip the edges of the corresponding insulation-displacement and retaining slits.

Thus, interconnection is achieved without it being necessary to provide a special structure in the region of the connecting terminal.

As a preference, the gripping is achieved at the end of that region of the insulation-displacement and retaining slit which is intended to retain a wire that is to be connected, this end being on the side from which the wire that is to be connected is introduced into the slit. Specifically, this is a region in which good contact is possible and easily accessible because the wire that is to be connected is intended to have access to this region.

The invention also provides a device for interconnecting connecting terminals comprising a connecting strip from which contact pins extend.

According to the invention, the connecting strip extends in a plane perpendicular to the direction in which the pins extend; a connecting pin extends from each of the two opposed longitudinal edges of the connecting strip in the region of each connecting terminal, and two connecting pins facing each other form a clip.

A device of this kind is easy to produce. Specifically, all that is required is for a metal strip to be cut and bent to form such a device. These are simple and commonplace operations. The cost of such a component is fairly low.

The edges of the slit for retaining the conducting part can sit in the clip. The pins therefore work by parting from one another, whereas, in conventional interconnection devices, two pins facing each other work by moving closer together.

In one embodiment, a tooth extends between each two pins in the plane of the connecting strip on each longitudinal edge of the strip. The interconnection device according to the present invention can therefore additionally have an insulating protection formed of an extruded section made of insulating synthetic material which slips over the teeth of the two opposed longitudinal edges of the connecting strip.

An interconnection device is intended, for example, to interconnect connecting terminals with insulation-displacement and retaining slits, these terminals each being placed in an insulating casing having an opening to allow the passage of and to guide the translation of an external tool designed to push a wire between folds delimiting the edges of the insulation-displacement and retaining slit. A connecting terminal of this kind is described, for example, in patent EP-0 247 360. In this case, the pins on the connecting strip side are advantageously spaced apart and have a width such that they are guided through the opening intended for the passage and guidance of the external tool and, in the connected position, the free ends of the pins preferably lie one on each side of the folds delimiting the edges of the insulation-displacement and retaining slit.

In this configuration, there is no need to envisage any adaptation at the connecting terminal to allow connection to an adjacent connecting terminal because connection is achieved via an orifice originally intended for the passage of an external tool to allow a connectable wire to be connected into the connecting terminal.

When the connection device according to the invention is intended to interconnect connecting terminals with insulation-displacement and retaining slits, these terminals each being placed in an insulating casing having an opening to allow the passage of and to guide the translation of an external tool designed to push a wire between folds delimiting the edges of the insulation-displacement and retaining slit, the insulating casing having a rim intended to take a projection on which the external tool can catch, then each pin advantageously has a boss intended to sit in the catching rim when the clip is in the connected position. This allows the connection device to be held in the connected position. A connecting terminal of this kind is described, for example, in patent EP-0 265 321.

To allow the length of the interconnection device according to the invention to be adapted to suit the user's requirements, the connecting strip advantageously has cutouts made in advance.

BRIEF DESCRIPTION OF THE DRAWINGS

In any event, the invention will be clearly understood with the aid of the description which follows, with reference to the diagrammatic appended drawing which, by way of non-limiting example, represents one preferred embodiment of an interconnection device according to the invention and illustrates the method of the invention.

DESCRIPTION OF THE PREFERRED EMBODIMENT

Figure 1:
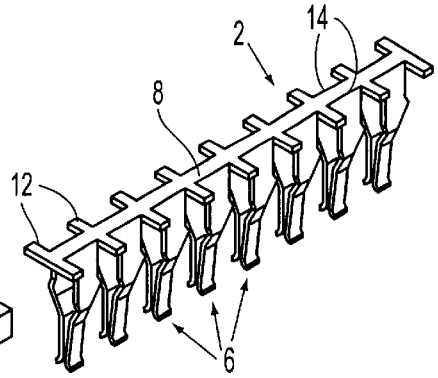
FIG. 1 shows an interconnection device according to the invention in an exploded perspective.
Figure 1:
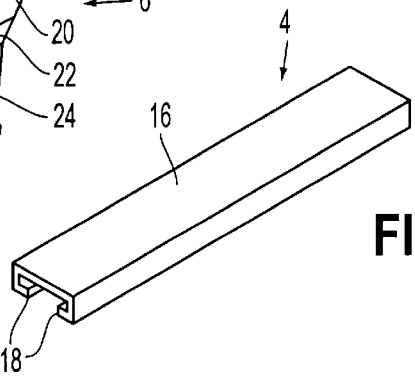
Figure 3:
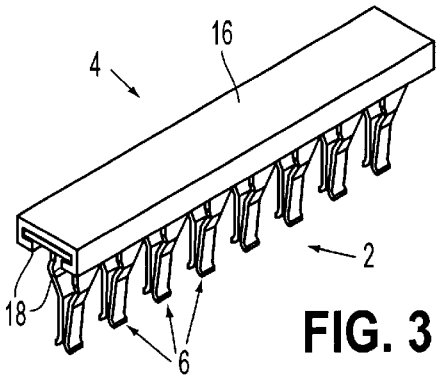
FIG. 3 shows the device of FIG. 2 in the mounted position.

The interconnection device according to the invention depicted in FIG. 1 consists of two separate parts: an interconnection comb 2 and an insulating cap 4.

Figure 2:
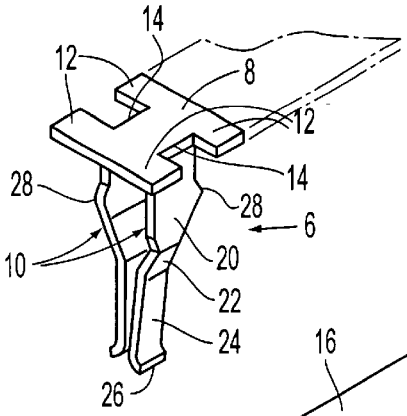
FIG. 2 shows, at a greater scale, a part forming a clip of the piece depicted in FIG. 1.

The interconnection comb 2 is a succession of clips 6 as depicted in FIG. 2. This comb 2 is made of a strip of metal, for example tinned copper alloy, which has been cut and bent.

The interconnection comb 2 exhibits a connecting strip 8, pins 10 which, in pairs, form a clip 6, and teeth 12.

The connecting strip 8 extends in a plane hereinafter known as the horizontal plane. The pins 10 all extend on the same side of this horizontal plane in an overall direction perpendicular to this plane and known as the vertical direction. It will be noted that the pins 10 extend vertically downward. The pins 10 each extend from a longitudinal edge 14 of the connecting strip 8. Corresponding to each pin 10 is a second pin 10 which, with the first pin, forms a clip 6. The two pins 10 face each other and the second pin 10 originates at the longitudinal edge opposite the longitudinal edge at which the first pin 10 originates.

Between each two pins 10 extending from one same longitudinal edge 14 of the connecting strip 8 is a tooth 12. The latter also originates at the longitudinal edge 14 but extends in the horizontal plane. The shape of the connecting strip 8 with the teeth 12 is thus reminiscent of a succession of "H"s placed side by side.

The insulating cap 4 is made of electrically insulating synthetic material. This is an extruded section with a flat face 16 intended to cover the connecting strip 8 and the teeth 12. The longitudinal edges of the flat face 16 have returns 18 intended to grip the free ends of the teeth 12 from underneath. This section may thus be slid along the interconnection comb in the region of the connecting strip 8 and the teeth 12.

Figure 6:
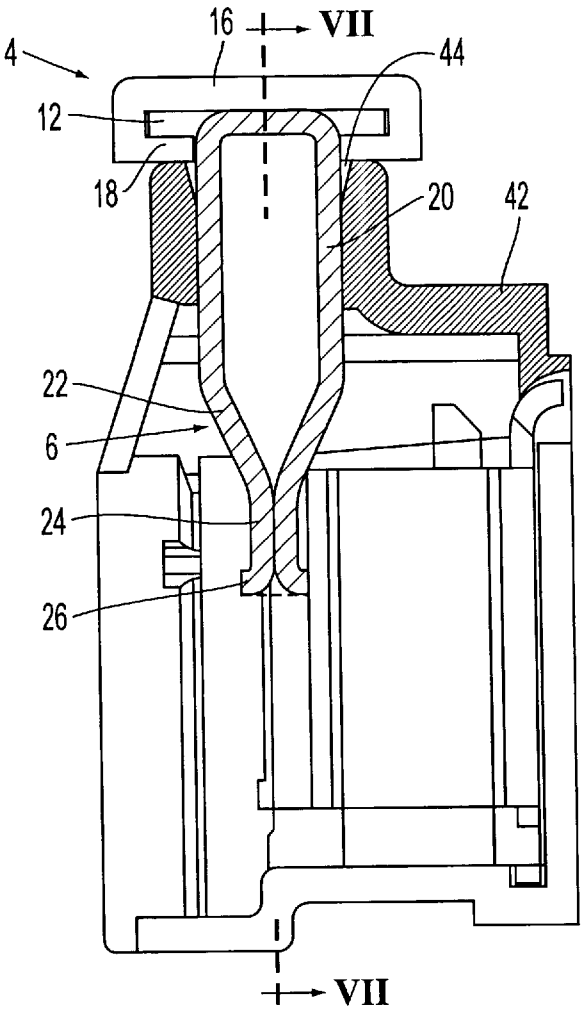
FIG. 6 is a view in section on a larger scale on the section line VI—VI of FIG. 5, the assembly depicted in FIG. 5 being mounted in an insulating casing.

As mentioned earlier, each pin 10 extends at right angles to the connecting strip 8 from a longitudinal edge 14 thereof. Starting from the longitudinal edge 14, each pin 10 has a guide face 20, a neck 22, a region forming a jaw 24, and a curved end 26 (FIG. 6).

The guide face 20 is a flat face running at right angles to the connecting strip 8 and to the horizontal plane. There is a boss 28 in the plane of the guide face 20 on one edge thereof.

The neck 22 is in a plane which is inclined with respect to the guide face 20. It runs toward the second pin 10, forming a clip 6 with the pin described here. This neck region 22 is narrower than the guide face 20.

The jaw-forming region 24 makes an angle of a few degrees with the perpendicular to the horizontal plane so that the two jaw-forming regions 24 facing each other converge in the direction away from the connecting strip 8.

Finally, the end 26 of the jaw-forming region 24 is curved outward, that is to say away from the other pin of the clip.

The two jaw-forming regions 24 are intended to sandwich between them a conducting part that is to be interconnected.

Figure 4:
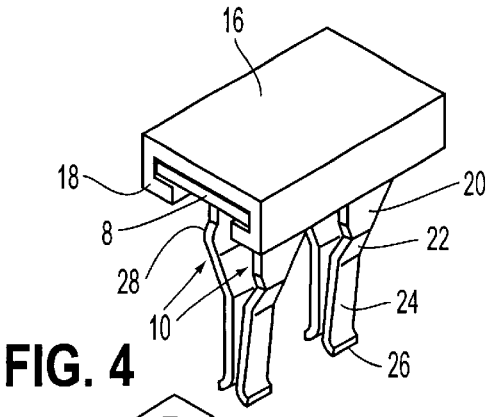
FIG. 4 is a view in exploded perspective showing two clips such as those depicted in FIG. 1 with two corresponding connecting terminals.

FIG. 4 shows an interconnection device like the one described hereinabove and two connecting pieces 30 to be electrically connected. These connecting pieces 30 have adopted the characteristics, as far as their shape is concerned, of connecting pieces already known from patents in the prior art, such as document EP-0 247 360 or EP-0 265 321, for example.

Each piece 30 has an insulation-displacement and retaining slit 32 which is straight and parallel to the longitudinal axis of the profiled connecting piece 30. It is, for example, obtained from a flat blank stamped to produce a cutout then folded and possibly thinned locally.

The connecting piece 30 here has a hollow polygonal cross section which corresponds to a U comprising a base 34 and two branches 36, the free ends of which have been obliquely and evenly folded one toward the other. The free end of each bent-over part 38 forms one edge of the insulation-displacement and retaining slit 32. These parts 38 are possibly gradually thinned toward the slit 32.

The insulation-displacement and retaining slit 32 at one of its ends has an insulation-displacement mouth 40. This is obtained by symmetrically cutting the bent-over parts 38 obliquely at their ends. This oblique cut makes it possible to obtain a flared mouth, the edges of which form a sharp edge for cutting into the sheath of a wire pushed into the mouth.

Figure 5:
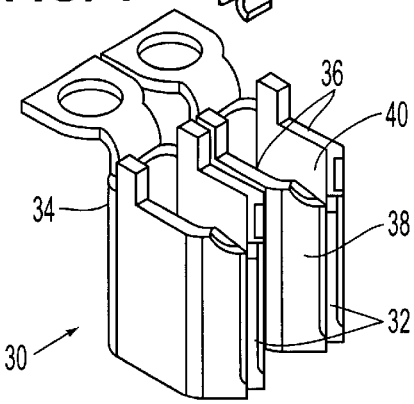
FIG. 5 shows the same elements as the preceding figure, but in the mounted position.
Figure 5:
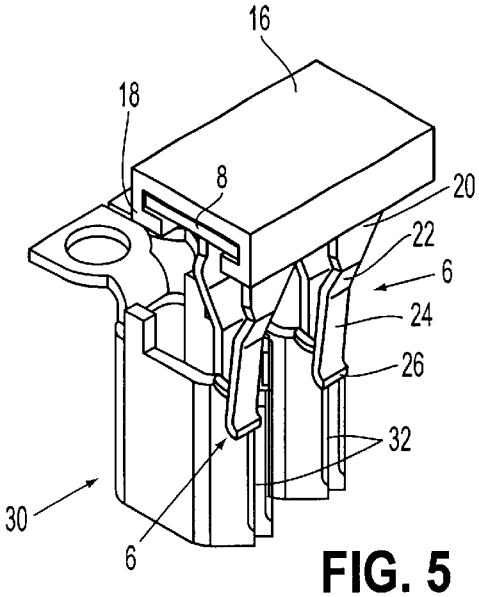

As can be seen, particularly in FIG. 5, electrical contact between a pin 10 and a connecting piece 30 occurs at the edges of the slit 32, on the mouth 40 side, in a region of the slit 32 intended to retain an electric wire that is to be connected. A region 24 forming the jaw of the pin 10 therefore lies inside the section of hollow polygonal cross section, while the jaw-forming region 24 of the pin 10 associated with it is outside this section. The presence of the bent-over ends 26 on the pins makes the pins 10 easier to part, this parting being brought about when the pin 10 comes into contact with the connecting piece 30.

Figure 7:
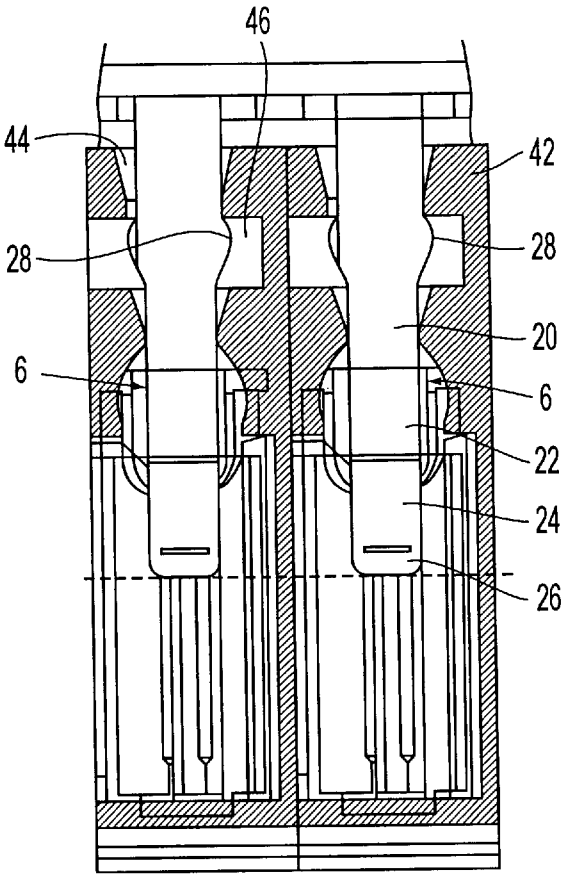
FIG. 7 is a view in section on the line VII—VII of FIG. 6.

FIGS. 6 and 7 show the connecting pieces 30 of FIGS. 4 and 5 in place in an insulating casing 42 of a junction block. The latter corresponds to a junction block as described in European Patent 0 265 321. This casing 42 comprises an introduction orifice 44 intended for the passage of a blade of an external tool to allow a wire to be connected at the connecting piece 30. This introduction orifice 44 has catching edges 46 intended to take mobile attachment elements borne by the end of the tool as described in Patent EP-0 265 321.

The clips 6 of the interconnection comb 2 pass through the introduction orifice 44 to make the electrical connection between two adjacent connecting pieces 30.

The width of the guide face 20 of each pin 10 and the spacing between two pins 10 of a clip 6, which spacing roughly corresponds to the width of the connecting strip 8, are tailored to this introduction orifice 44 so as to allow good guidance of the clip 6 upon connection. The boss 28 on each guide face 20 is located in such a way that when connection between the pin 10 and the corresponding connection piece 30 is made, the boss 28 takes up a position just beneath the catching rim 46. This then allows the interconnection comb 2 to be held in place on the junction block.

The interconnection device described hereinabove is particularly simple to produce. This is because the operations of cutting and bending are operations that can be automated and are in widespread use. The fact of having an insulating cap 4 which can be slipped over the interconnection comb also makes the interconnection device easy to produce.

To tailor the size of the interconnection device according to the invention to the user's requirements, it is possible to provide a precutout made in advance at the teeth 12. Starting out with a long interconnection device, it is therefore possible to produce an interconnection device of the chosen size with as many clips 6 as there are junction blocks to be connected.

Another advantage of the interconnection device described hereinabove is that it can be fitted to junction blocks which have no special structure designed to take an interconnection comb. Specifically, the device described can be connected at an orifice whose main function is the passage of a tool for connecting a wire to the connection piece located inside the junction block.

As goes without saying, the invention is not restricted to the preferred embodiment of the invention which has been described hereinabove by way of non-limiting example; on the contrary, it encompasses all alternative forms that fall within the scope of the claims which now follow.

What is claimed is:

1. A method for interconnecting a plurality of connecting terminals, each terminal exhibiting an insulation-displacement and retaining slit for connecting a wire, the method comprising the steps of:

using an interconnection device comprising:

a connecting strip having two opposed longitudinal edges;

a plurality of first contact pins extending from one of the longitudinal edges in a direction perpendicular to the connecting strip;

a plurality of second contact pins extending from the other longitudinal edge in a direction perpendicular to the connecting strip, each second contact pin facing a first contact pin;

wherein each pair, constituted by a first contact pin and a second contact pin facing each other, forms a clip; and gripping with a clip formed by a pair of contacts the edges of the insulation-displacement and retaining slit of each connecting terminal that is to be interconnected.

2. The interconnection method as claimed in claim 1, wherein the gripping is achieved on the side of an insulation-displacement mouth of each insulation-displacement and retaining slit.

3. The interconnection method as claimed in claim 1, further comprising the steps of:

providing the connecting strip with precutouts made between the clips during fabrication of the interconnection device; and adjusting the length of the interconnection device and the number of clips provided by the interconnection device by cutting the connecting strip along at least one precutout.

4. A method for interconnecting a plurality of junction blocks, each junction block comprising an insulating casing in which is placed a connecting terminal exhibiting an insulation-displacement and retaining slit for connecting a wire, the casing having an introduction opening, to allow the passage of and to guide the translation of an external tool designed to push the wire in the insulation-displacement and retaining slit, the method comprising the steps of:

using an interconnection device comprising:

a connecting strip having two opposed longitudinal edges;

a plurality of first contact pins extending from one of the longitudinal edges in a direction perpendicular to the connecting strip;

a plurality of second contact pins extending from the other longitudinal edge in a direction perpendicular to the connecting strip, each second contact pin facing a first contact pin;

wherein each pair, constituted by a first contact pin and a second contact pin facing each other, forms a clip; and introducing a clip formed by a pair of contacts in the introduction opening of each junction block that is to be interconnected, and gripping with the clip the edges of the insulation-displacement and retaining slit of the connecting terminal placed in the junction block.

5. The interconnection method as claimed in claim 4, further comprising the step of closing with the interconnection device the introduction opening of each junction block that is to be interconnected.

6. The interconnection method as claimed in claim 4, wherein the gripping is achieved on the side of an insulation-displacement mouth of each insulation-displacement and retaining slit.

7. The interconnection method as claimed in claim 4, further comprising the step of guiding the clip during its introduction with the wall of the introduction opening.

8. The interconnection method as claimed in claim 4, further comprising the step of holding in place the interconnection device by catching a boss exhibited by each contact pin with a catching rim exhibited by the introduction opening.

9. The interconnection method as claimed in claim 4, further comprising the steps of:

providing the connecting strip with precutouts made between the clips during fabrication of the interconnection device; and adjusting the length of the interconnection device and the number of clips provided by the connection device by cutting the connecting strip along at least one precut-out.

10. An interconnection device for interconnecting connecting terminals, comprising:

a connecting strip having two opposed longitudinal edges;

a plurality of first contact pins extending from one of the longitudinal edges in a direction perpendicular to the connecting strip;

a plurality of second contact pins extending from the other longitudinal edge in a direction perpendicular to the connecting strip, each second contact pin facing a first contact pin, wherein each pair, constituted by a first contact pin and a second contact pin facing each other, forms a clip, wherein each contact pin comprises a flat region forming the jaw of the clip for gripping an insulation displacement slit of a connecting terminal and wherein the connection strip comprises, on each longitudinal edge and between each two pins along the longitudinal edge, a tooth extending in the plane of the connecting strip.

11. The interconnection device as claimed in claim 10, which additionally comprises an insulating cap which is slipped over the teeth of the two opposed longitudinal edges of the connecting strip.

12. The interconnection device as claimed in claim 10, wherein each pin comprises a holding boss.

13. The interconnection device as claimed in claim 10, wherein the connecting strip comprises precutouts between the clips.

14. The interconnection device as claimed in claim 10, wherein the strip and the contact pins are made out of a cut and folded metal strip.

15. The interconnection device as claimed in claim 10, wherein each contact pin comprises, starting form the longitudinal edge of the strip, a guide face, a neck, a flat region forming the jaw and a curve end.

16. The interconnection device as claimed in claim 15, wherein the flat jaw-forming regions, of two pins facing each other, converge in the direction away form the connecting strip.

17. The interconnection device as claimed in claim 15, wherein each pin comprises on one edge of the guide face a holding boss.

18. An interconnecting assembly comprising a plurality of connecting terminals and at least one interconnection device wherein:

each terminal comprises an insulation-displacement and retaining slit for connecting a wire;

the interconnection device comprises:

a connecting strip having two opposed longitudinal edges, a plurality of first contact pins extending from one of the longitudinal edges in a direction perpendicular to the connecting strip, and a plurality of second contact pins extending from the other longitudinal edge in a direction perpendicular to the connecting strip, each second contact pin facing a first contact pin;

each pair, constituted by a first contact pin and a second contact pin facing each other, forms a clip; and at least two of the connecting terminals are interconnected by the interconnection device, the edges of the insulation-displacement and retaining slit of each interconnected connecting terminal being gripped by a clip formed by a pair of contacts of the interconnection device.

19. The interconnecting assembly as claimed in claim 18, wherein each pin comprises a holding boss.

20. The interconnecting assembly as claimed in claim 18, wherein the connecting strip comprises precutouts between the clips.

21. The interconnecting assembly as claimed in claim 18, wherein the strip and the contact pins are made out of a cut and folded metal strip.

22. The interconnecting assembly as claimed in claim 18, wherein the connecting strip comprises on each longitudinal edge and between each two pins a tooth extending in the plane of the connecting strip.

23. The interconnecting assembly as claimed in claim 22, wherein the interconnection device comprises an insulating cap which is slipped over the teeth of the two opposed longitudinal edges of the connecting strip.

24. The interconnecting assembly as claimed in claim 18, wherein each contact pin comprises, starting from the longitudinal edge of the strip, a guide face, a neck, a flat region for forming a jaw and a curve end.

25. The interconnecting assembly as claimed in claim 24, wherein the flat jaw-forming regions, of two pins facing each other, converge in the direction away from the connecting strip.

26. The interconnecting assembly as claimed in claim 24, wherein each pin comprises on one edge of the guide face a holding boss.

27. An interconnecting assembly comprising a plurality of junction blocks, and at least one interconnection device wherein:

each junction block comprises an insulating casing in which is placed a connecting terminal exhibiting an insulation-displacement and retaining slit for connecting a wire, the casing having an introduction opening to allow the passage of and to guide the translation of an external tool designed to push the wire in the insulation-displacement and retaining slit;

the interconnection device comprises:

a connecting strip having two opposed longitudinal edges, a plurality of first contact pins extending from one of the longitudinal edges in a direction perpendicular to the connecting strip, and a plurality of second contact pins extending from the other longitudinal edge in a direction perpendicular to the connecting strip, each second contact pin facing a first contact pin, each pair, constituted by a first contact pin and a second contact pin facing each other, forms a clip; and at least two of the junction blocks are interconnected by the interconnecting device, the edges of the insulation-displacement and retaining slit of the connecting terminal of each interconnected junction blocks being gripped by a clip formed by a pair of contacts of the interconnection device.

28. The interconnecting assembly as claimed in claim 27, wherein each pin comprises a holding boss.

29. The interconnecting assembly as claimed in claim 27, wherein the connecting strip comprises precutouts between the clips.

30. The interconnecting assembly as claimed in claim 27, wherein the strip and the contact pins are made out of a cut and folded metal strip.

31. The interconnecting assembly as claimed in claim 27, wherein the introduction opening of each interconnected junction block is closed with the interconnection device.

32. The interconnecting assembly as claimed in claim 27, wherein the connecting strip comprises on each longitudinal edge and between each two pins a tooth extending in the plane of the connecting strip.

33. The interconnecting assembly as claimed in claim 32, wherein the interconnection device comprises an insulating cap which is slipped over the teeth of the two opposed longitudinal edges of the connecting strip.

34. The interconnecting assembly as claimed in claim 27, wherein each contact pin comprises, starting from the longitudinal edge of the strip, a guide face, a neck, a flat region for forming a jaw and a curve end.

35. The interconnecting assembly as claimed in claim 34, wherein the flat jaw-forming regions, of two pins facing each other, converge in the direction away from the connecting strip.

36. The interconnecting assembly as claimed in claim 34, wherein each pin comprises on one edge of the guide face a holding boss.

* * * * *